US005954427A

United States Patent [19]

Campos et al.

[11] Patent Number: 5,954,427

[45] Date of Patent: Sep. 21, 1999

[54] AUTOMOTIVE TAIL LAMP WITH LARGE RAKE ANGLE

[75] Inventors: Mario Alejandro Campos, Dearborn Heights, Mich.; Milan Cejnek; Marek Olivik, both of Novy Jicin, Czech Rep.

[73] Assignee: Ford Motor Company, Dearborn, Mich.

[21] Appl. No.: 08/964,993

[22] Filed: Nov. 5, 1997

[51] Int. Cl.[6] ..... F21Q 1/00

[52] U.S. Cl. ..... 362/517; 362/346; 362/297

[58] Field of Search ..... 362/516, 517, 362/346, 297

[56] References Cited

U.S. PATENT DOCUMENTS

| | | | |
|---|---|---|---|
| 4,153,929 | 5/1979 | Laudenschlarger et al. . | |
| 4,481,563 | 11/1984 | Snyder et al. . | |
| 4,559,589 | 12/1985 | Sassmannshausen . | |
| 4,630,184 | 12/1986 | Ferrero | 362/346 X |
| 4,704,661 | 11/1987 | Kosmatka . | |
| 4,722,023 | 1/1988 | Arima et al. . | |
| 4,740,871 | 4/1988 | Dilouya . | |
| 4,798,448 | 1/1989 | van Raalte | 362/297 X |
| 4,962,450 | 10/1990 | Reshetin | 362/297 X |
| 4,994,947 | 2/1991 | Fesko | 362/297 |
| 5,065,287 | 11/1991 | Staiger et al. . | |
| 5,204,820 | 4/1993 | Strobel et al. . | |
| 5,406,464 | 4/1995 | Saito . | |
| 5,556,194 | 9/1996 | Natsume et al. | 362/346 X |

*Primary Examiner*—Laura K. Tso
*Attorney, Agent, or Firm*—DAvid B. Kelley

[57] ABSTRACT

A tail lamp for use on an automotive vehicle with a large rake angle has a lens, a reflector, a source of light and a means for attachment of the tail light to the vehicle. The reflector has a pillowed reflective surface that is substantially vertically oriented and rearward facing, having a basic surface provided with a plurality of pillows. Each of the pillows has a set of corner control points defining the corners of said pillow, a set of edge control points defining the edges of said pillow and a set of interior control points. Each pillow also has a predetermined horizontal curvature angle from a tangent of the basic surface to a horizontal tangent of the pillowed surface and a predetermined vertical curvature angle from a tangent of the basic surface to a vertical tangent of the pillowed surface, measured at a corner control point of said pillow. The lens has a plurality of flutes on an interior surface thereof.

19 Claims, 3 Drawing Sheets

AUTOMOTIVE TAIL LAMP WITH LARGE RAKE ANGLE

FIELD OF THE INVENTION

The present invention relates to automotive vehicle lamps in general, and more specifically to a vehicle tail lamp which creates horizontal and vertical light spread by pillows at a reflector surface and additional side light spread by fluting of a lamp lens.

BACKGROUND OF THE INVENTION

Conventional automotive vehicle tail lamps, which may include a signal lamp therein, are typically mounted to a vehicle with a relatively small lens rake angle. To achieve a desired light intensity distribution, these lamps have light distributing facets or pillows on an inner reflector surface, or a combination of facets on a reflection surface of a lamp reflector and optical patterned lenses.

The design of the facets or pillows is important in producing a desired optical pattern. Prior art shows the use of many different methods to determine facet shape. For example, U.S. Pat. No. 5,204,820, Strobel, et. al. and, U.S. Pat. No. 5,065,287 Staiger et. al. disclose the use of a Bezier type formulation to design the surface shape of reflector pillows in a headlight application.

Such lamps are insufficient, however, when mounted on a sloping C-pillar in the rear of a hatch-back type vehicle due to the large lens rake angle of the lamp. This large rake angle results in asymmetry of the light spread due to the inclined pillow position and the deviation from linearity of the light spread where straight spread lines are changed to arced spreading curves. In addition, conventional lamps have a disadvantage in the sloping C-pillar environment since the light spreading surface is situated relatively deep inside the vehicle and side visibility is reduced by side reflector walls, particularly in the inboard direction.

To correct for these problems, conventional lamps have added features such as additional inner lenses and extra bulbs, which increase lamp expense and assembly time.

SUMMARY OF THE INVENTION

The disadvantages named above are overcome by a lamp in accordance the present invention which achieves the required vertical and horizontal light spread by use of both shaped reflector pillows and lens flutes. The combination of the flutes and pillows reduces asymmetry and non-linearity of horizontal and vertical light spread.

The tail lamp comprises a lens having a plurality of flutes on an interior surface thereof, the plurality of flutes being oriented from a vertical axis at an angle $\alpha$, the plurality of flutes also having a predetermined ratio $W_1/R_1$, where $W_1$ is the width of each of the plurality of flutes, and $R_1$ is the radius of each of the plurality of flutes.

The tail lamp further comprises a reflector shaped as either a sphere, paraboloid, ellipsoid or hyperboloid. The reflector has a rearward facing reflective inner surface oriented at substantially the rake angle of the pillar, a depression in the rearward facing inner surface having a pillowed reflective surface substantially vertically oriented and rearward facing, and a generally outboard facing surface connected to the rearward facing reflective inner surface inboard thereof.

The pillowed reflector surface has a plurality of pillows designed using a Bezier formulation. The surface of each of the pillows has a horizontal curvature angle ($\theta_h$) measured from a normal of the inner surface to a normal of the pillow surface at a corner point and a vertical curvature angle ($\theta_v$) measured from normal of the inner surface to a normal of the pillow surface at a corner point. Each of the pillows has a pillow surface with a horizontal and a vertical cross-section shaped as either a circle and ellipse.

An advantage of the present invention is a reduction in asymmetry and non-linearity of the horizontal and vertical light spread due to a large lens rake angle.

Another advantage is a reduction in the shielding effect of the reflector side walls.

BRIEF DESCRIPTION OF THE DRAWINGS

These and other objects, advantages, and features of the present invention will be apparent to those skilled in the vehicle tail lamp arts upon reading the following description with reference to the accompanying drawings, in which.

DETAILED DESCRIPTION OF THE PREFERRED EMBODIMENT

Figure 1:
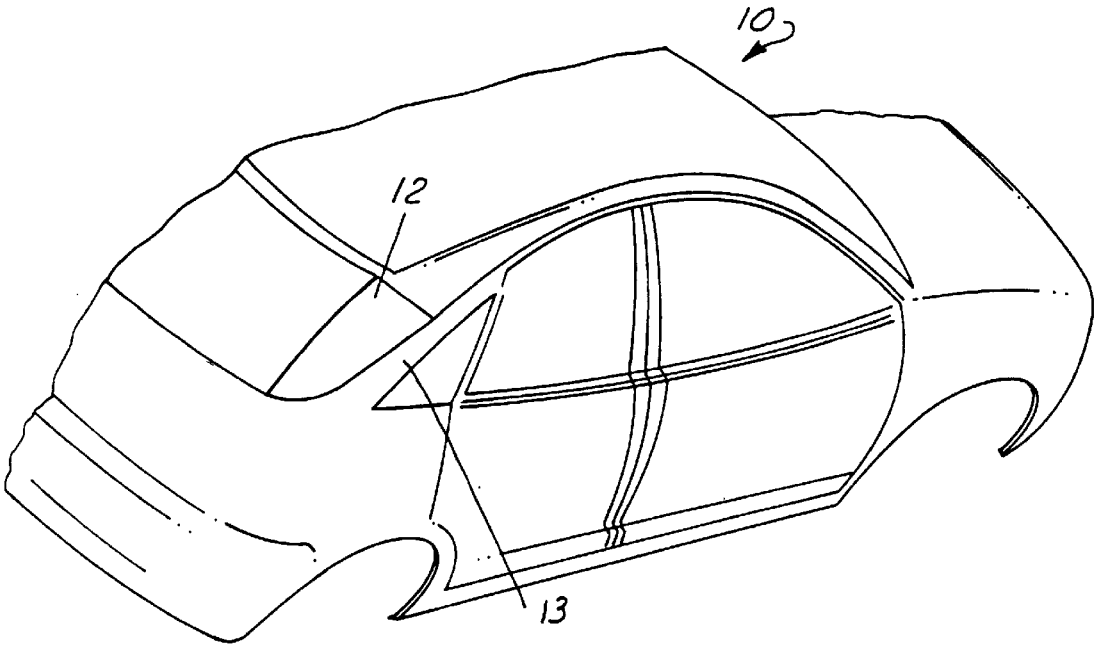
FIG. 1 is a perspective view of an automotive vehicle having a tail lamp according to an embodiment of the present invention.
Figure 2:
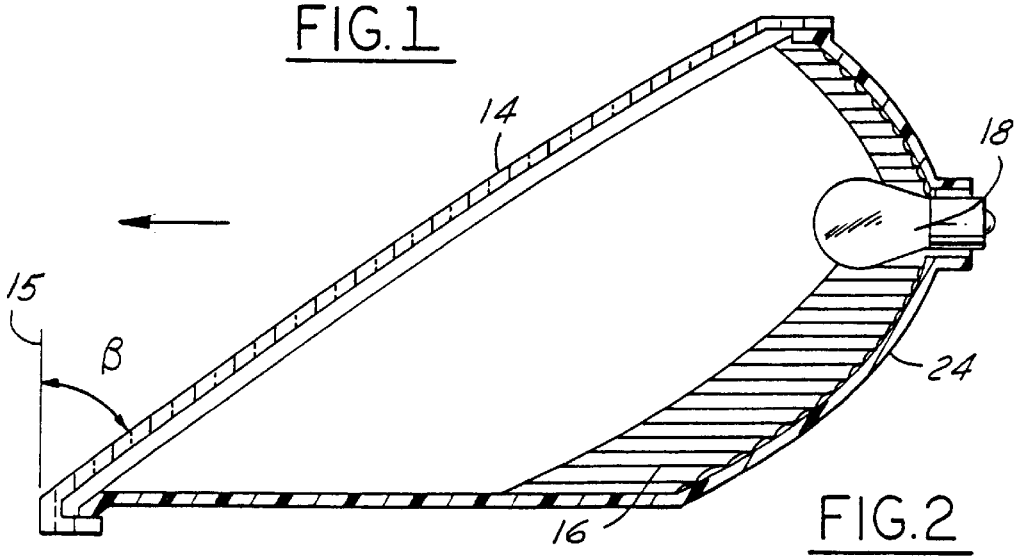
FIG. 2 presents the lamp in vertical section.
Figure 3:
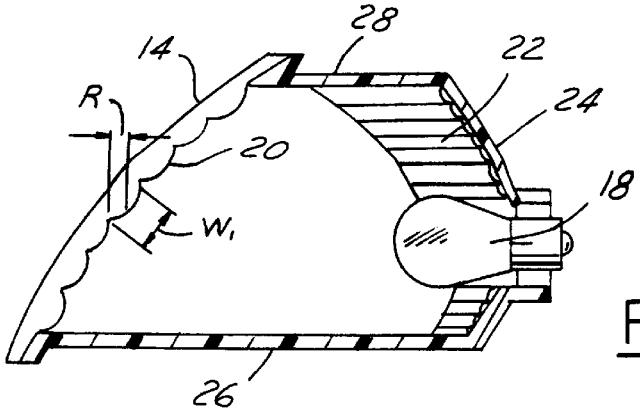
FIG. 3 presents the lamp in horizontal section.

Turning now to the drawings, and in particular to FIG. 1, a vehicle 10 is shown having a tail light 12 mounted in a rearward fashion in the C-pillar. FIG. 2, a vertical cross section of the tail light 12, shows a lens 14 and in particular a large rake angle $\beta$ between the lens 14 and a local vertical axis 15. A reflector 16 has a light source 18, which provides light to be directed through lens 14. FIG. 3 shows lens 14 provided with strip flutes 20 having width $W_1$ and radius $R_1$, designed to direct light reflected from reflector 16 in a specified directional pattern.

Figure 4:
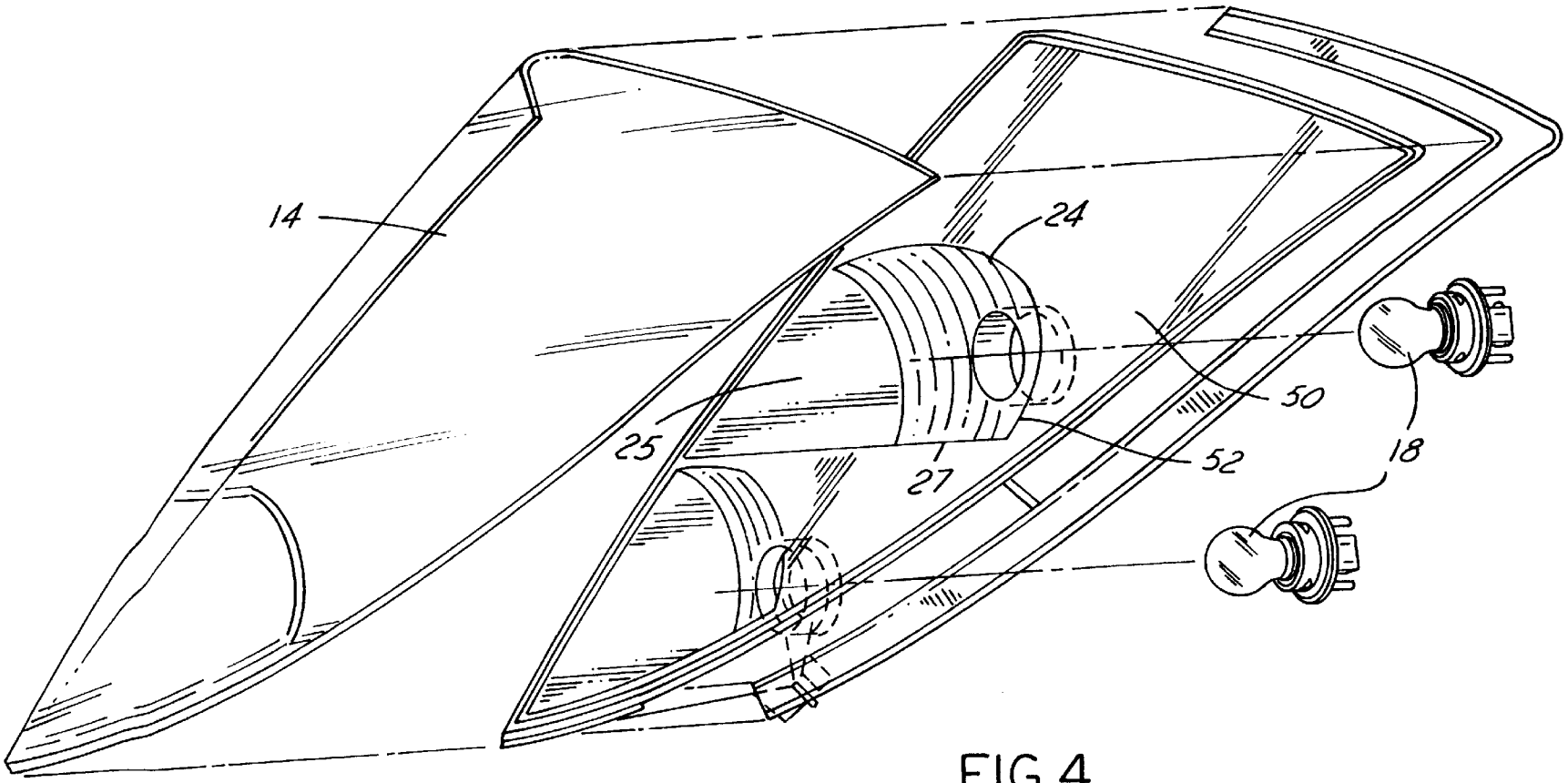
FIG. 4 is an exploded, perspective view of a tail lamp according to the present invention.

The reflector 16 is formed from a rearward facing reflective inner surface 50 oriented at substantially the rake angle $\beta$ of the lens, having a depression 52, where the depression is comprised of three general surfaces as shown in FIG. 4: a basic surface 24, an adjacent generally outboard facing surface 25; and, a generally horizontal reflective surface 27. The basic surface 24 of reflector 16 has generally the geometry of a sphere, paraboloid, ellipsoid or hyperboloid, and is provided with a plurality of pillows 22 that are designed to reflect light from the light source 18 through the lens 14, as shown in FIG. 3. The generally concave basic surface 24 of reflector 16 is limited in width by side walls 26,28 of the tail light 12. The combination of the pillows 22 on the reflector 16 and the flutes 20 of the lens 14 is used in the present invention to achieve the desired light distribution by overcoming the barriers of the large vertical rake angle β and the limiting side walls 26,28, as shown below.

Each of the pillows 22 of the reflector basic surface 24 are designed as shown in FIGS. 6–10, in either a convex or concave fashion such that the corners 30 of each pillow 22 are attached to the basic reflector surface 24 of the reflector 16. The cross section of each pillow 22 is generally shaped as a circle or ellipse and has a pillow surface 36 defined by a Bezier formulation according to the present invention.

Figure 9:
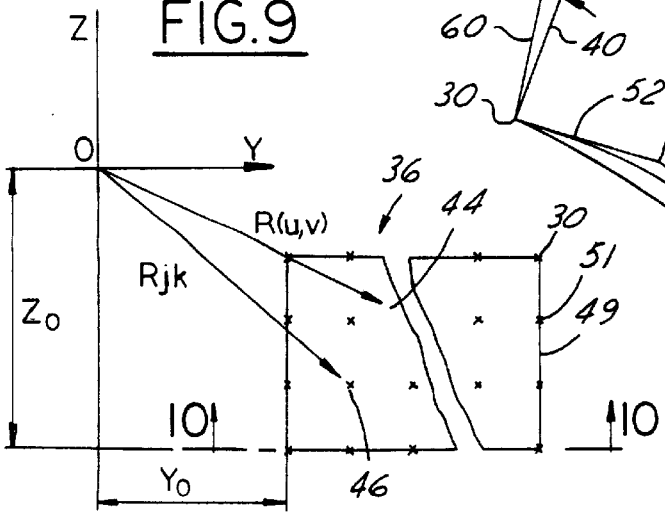
FIG. 9 shows a diagrammatic front view of a reflector surface having a pillow shaped according to the Bezier formulation of the present invention.
Figure 10:
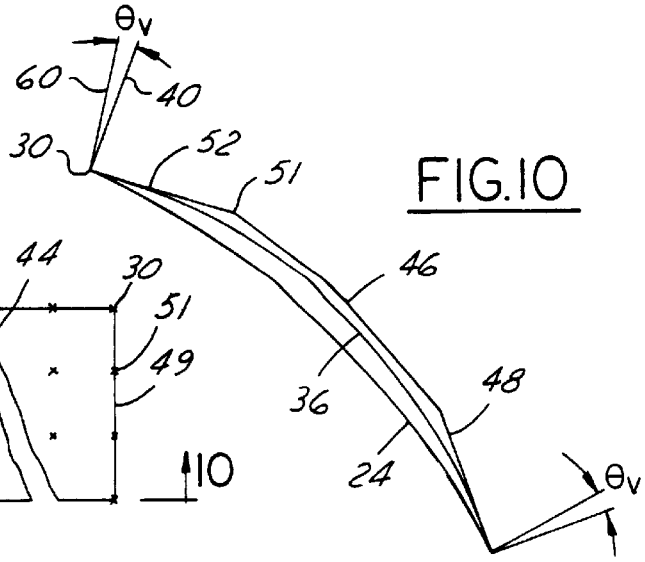
FIG. 10 is a horizontal sectional view through line 10—10 of FIG. 9.

The Bezier method is a method of curve fitting, wherein predetermined control points are used to fit a curve or surface. The choice of the location of the control points determines the final shape of the Bezier surface. In the present invention, a basic work surface 24 is defined, with corner control points 30 attached thereto. Referring now to FIGS. 9–10, the control points 51 along the edges 49 of the pillow surface 36 are then determined such the normal 60,64 of a line 52 connecting a corner point control point 30 and a neighboring control point 51, and the normal 40,42 of the basic surface 24 at a corner control point 30 form angle ($\theta_h$) in the horizontal plane and angle ($\theta_v$) in the vertical plane. An interior control point 46 is then determined such that the interior control point 46, neighboring control points 51 along adjacent edges 49, and adjacent corner control point 30 form a rhomboid in the plane given by the corner control points and the adjacent edge. Thus the choice of control points 44 is done to match the desired optical pattern in a single step.

Strobel et. al and Staiger et. al teach use of a Bezier equation to design pillow shapes in an iterative method which mathematically manipulates local regions of an initial representation until a resulting mathematical surface representation defines a surface having desired optical properties. Thus Strobel defines a Bezier surface, then iteratively moves control points until a desired light distribution is achieved. In contrast, the present invention defines control points 30,46,51 so that the horizontal and vertical curvature angles are half of the light spread angle needed to achieve a desired light output, then fits a Bezier curve to those control points in a single step, thus saving time in the design process.

In order to create a desired horizontal light spread, the horizontal angle $\theta_h$ is set according to the desired horizontal light spread. The angle $\theta_h$ is defined as the angle between the local normal 40 of the basic surface 24 at the corner control point 30 and a line 60 perpendicular to a line connecting the corner control points 30 to adjacent control points along the horizontal edge 51 at the same corner control point 30. In a preferred embodiment, $\theta_h$ is set between 2.5° and 25°. Thus the horizontal tangent of the pillow surface 36 at the corner control point 30 forms angle $\theta_h$ with the local horizontal tangent of the basic surface 24 at the corner point 30.

In order to create a desired vertical light spread, the vertical angle $\theta_v$ is set according to the desired vertical light spread. The angle $\theta_v$ is defined as the angle between the local normal 40 of the basic surface 24 at the corner control point 30 and a line 64 perpendicular to a line connecting the corner control points 30 to adjacent control points along the vertical edge 51 at the same corner control point 30. In a preferred embodiment, $\theta_v$ is set between 1.5° and 15°. Thus the vertical tangent of the pillow surface 36 at the corner control point 30 forms angle $\theta_v$ with the local vertical tangent of the basic surface 24 at the corner point 30.

Referring now specifically to FIG. 9, the Bezier formulation of pillow surface 36 of pillow 22 is expressed with the vertical parametric equation $$R(u, v) = \sum_{j,k=0}^{M,N} \left(\frac{M!}{j!(M-j)!}\right)\left(\frac{N!}{k!(N-k)!}\right) u^j v^k (1-u)^{M-j}(1-v)^{N-k} R_{jk}$$

where, u, v—parameters of the pillow surface 36 of a pillow 22

R(u,v)—position vector of a point 44 on the pillow surface 36 of a pillow 22

$R_{jk}$—position vectors of control points 46 on the pillow surface 36 of pillow 22

M,N—degrees of the pillow surface 36

The use of this equation is demonstrated as follows for a Bezier surface of 3rd degree in u and v (i.e. M=N=3) and for a parabolic basic surface 24. The position vectors of corner control points 30 are expressed as $$R_{mn} = (x_{mn},\ y_{mn},\ z_{mn}),$$

$$y_{mn} = Y_0 + \delta_{Mm} W,$$

$$z_{mn} = Z_0 + \delta_{Nn} H,$$

$$x_{mn} = \frac{(y_{mn}^2 + z_{mn}^2)}{4f}$$

where m=0 and n=0

W, H—width and height of pillow 22

$Y_0$, $Z_0$—left bottom corner coordinates 30 of pillow 22

$d_{ij}$—Cronecker symbol, $d_{ij}$=1 for i=j, $d_{ij}$=0 for i≠j

The optical effect of pillow 22 is determined by the selection of the control points 46, located by vector $R_{jk}$, neighboring corner control points 30. To ensure the desired horizontal and vertical light deviations the angle between the tangent of the basic surface 24 and the tangent of the pillow surface 36 at the corner control point 30 is made to be $\theta_h$,$\theta_v$ by selection of control points 46. The curvature of the pillow surface 36 in the vicinity of the corner control point 30 in the horizontal or vertical direction is managed by changing the location of a control point 46, thus changing the length of the corresponding abscissa 48, the longer the abscissa is, the smaller the curvature is.

Further, let $R_{jk}$ be a point nearby corner point 30 denoted $R_{mn}$ i e.j=m±1 and/or k=n±1, such that $R_{jk}$ is expressed as follows:

$$R_{jk}=R_{mn}+p_{kn}q_{jm}L_h(\theta_h)T_u \cdot M_h(\theta_h)+p_{jm}q_{kn}L_v(\theta_v)T_v \cdot M_h(\theta_v)$$

where $p_{ij}$=1 for i≧j, $p_{ij}$=−1 for i<j $q_{ij}$=0 for i=j, $q_{ij}$=1 for i≠j $L_h(q_h)$—length of abscissa 48 $R_{mn}-R_{jn}$ $L_v(q_v)$—length of abscissa $R_{mn}-R_{mk}$ $T_u$, ($T_v$)—unit tangent vector to basic surface 24 at the corner control point 30 in horizontal (vertical) direction $M_h(q_h)$, ($M_v(q_v)$ )—matrix of rotation in horizontal (vertical) plane.

The length of abscissa 48 is expressed by equation $$L_{h,v} = \frac{(1 + P_{h,v})D_{h,v}}{1 + 2\cos\theta_{h,v}}$$

where $P_{h,v}$—horizontal or vertical spread parameter $D_{h,v}$—distance of corner control points in horizontal or vertical plane.

Rotation matrices $M_h(q_h)$ and $M_v(q_v)$ are $$M_h(\theta_h) = \begin{pmatrix} \cos\theta_h & C\sin\theta_h & 0 \\ -C\sin\theta_h & \cos\theta_h & 0 \\ 0 & 0 & 1 \end{pmatrix}$$

$$M_v(\theta_v) = \begin{pmatrix} \cos\theta_h & 0 & C\sin\theta_h \\ 0 & 1 & 0 \\ -C\sin\theta_h & 0 & \cos\theta_h \end{pmatrix}$$

where

C=convex parameter.

Parameter C in equations determines whether the pillow surface 36 of pillows 22 is convex (C=1) or concave (C=−1).

The application of pillows 22 to the reflector 16 results in reduced asymmetry and non-linearity of the light spread, in conjunction with the utilization of light spreading flutes 20 on the inclined surface of lens 14.

Figure 5:
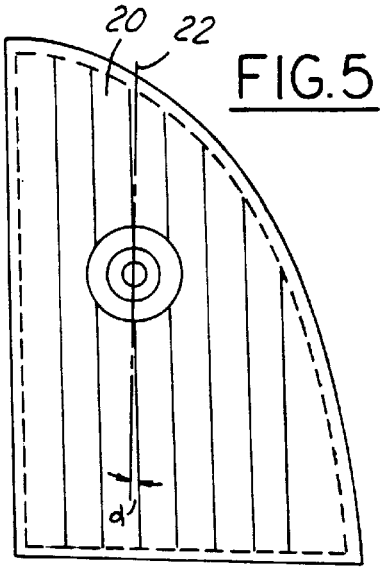
FIG. 5 is a front view of the tail lamp of FIG. 1.
Figure 6:
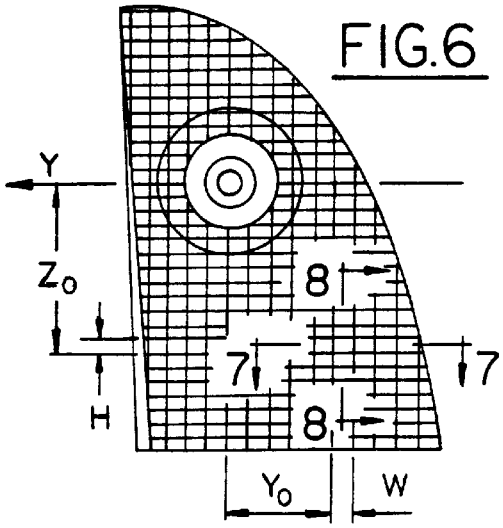
FIG. 6 is a front view of the lamp of FIG. 5 without a lens attached thereto.
Figure 7:
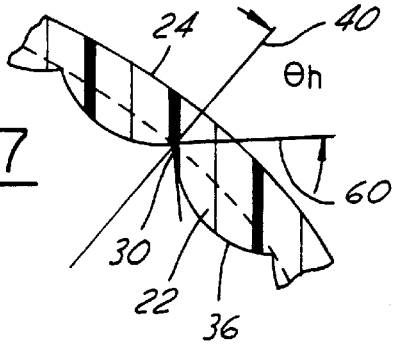
FIG. 7 is a horizontal sectional view through line 7—7 of FIG. 6.
Figure 8:
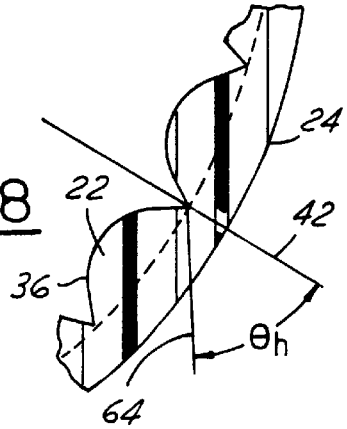
FIG. 8 is a vertical sectional view through line 8—8 of FIG. 6.

The flutes 20 (FIG. 5) have a vertical alignment angle α relative to the vertical axis 22. In the preferred embodiment of the present invention, α is between 0° and 35° while the ratio of the flute width $W_1$ to the radius of flute curvature $R_1$, $W_1/R_1$ is between 0.2 and 1.6. The pillows 22 cooperate with the flutes 20 of the lens 14, to direct a portion of light from the light source 18 rearward and inboard over the outboard facing reflective surface 25.

Although the preferred embodiment of the present invention has been disclosed, various changes and modifications may be made without departing from the scope of the invention as set forth in the appended claims.

We claim:

1. A tail lamp for use on an automotive vehicle, the tail lamp having a large rake angle, the tail lamp comprising:

a lens having a plurality of flutes on an interior surface thereof, the plurality of flutes being oriented from a vertical axis at an angle α, the plurality of flutes also having a predetermined ratio $W_1/R_1$ where $W_1$ is the width of each of the plurality of flutes, and $R_1$ is the radius of each of the plurality of flutes;

a reflector having an inner surface with a plurality of pillows, each of the plurality of pillows having a pillow surface with a set of defined control points, the set including at least three corner control points, at least two edge control points and at least one interior control point, and having a predetermined horizontal curvature angle ($\theta_h$) defined between a tangent of the inner surface to a tangent of the pillow surface and a vertical curvature angle ($\theta_v$) from a tangent of the inner surface to a tangent of the pillow surface, measured at said corner control points;

wherein the lens is mounted over reflector, and wherein each of said plurality of pillows of said reflector inner surface is shaped as described by a Bezier type equation as follows:

$$R(u, v) = \sum_{j,k=0}^{M,N} \left(\frac{M!}{j!(M-j)!}\right)\left(\frac{N!}{k!(N-k)!}\right) u^j v^k (1-u)^{M-j}(1-v)^{N-k} R_{jk}$$

wherein, u and v are position parameters for each of the plurality of pillows of the reflector inner surface;

R(u,v) is a position vector for a point on one of said plurality of pillows of the pillowed reflective surface;

j and k are counters in the equation;

$R_{jk}$ is a position vector of one of said control points on one of said plurality of pillows of the pillowed reflective surface; and M and N are dimensional limits in each dimension defining the pillowed surface;

means for generating light within the tail lamp; and means for attaching the tail lamp to the vehicle.

2. A tail lamp as recited in claim 1 wherein the control points of said pillow surface are such that a normal to a connection line between one of the at least three corner control points and an adjacent edge control point and the normal of the basic surface at said corner control point form angle ($\theta_h$) in the horizontal plane and angle ($\theta_v$) in the vertical plane.

3. A tail lamp as recited in claim 1, wherein each of said plurality of pillows has a pillow surface, and each of said pillow surfaces has a horizontal and vertical cross-section shaped as one of a circle and ellipse.

4. A tail lamp as recited in claim 1 wherein the surface of the reflector is shaped from one of a sphere, paraboloid, ellipsoid and hyperboloid.

5. A tail lamp as recited in claim 1, wherein said angle α is between approximately 0° and 35°.

6. A tail lamp as recited in claim 1, wherein said ratio $W_1/R_1$ is between approximately 0.2 and 1.6.

7. A tail lamp as recited in claim 1, wherein said horizontal curvature angle ($\theta_h$) is between approximately 2.5° and 25°.

8. A tail lamp as recited in claim 1, wherein said vertical curvature angle ($\theta_v$) is between 1.5° and 15°.

9. A tail lamp for use on a rear automobile pillar having a generally large rake angle, the tail lamp comprising:

a reflector having:

a rearward facing reflective inner surface oriented at substantially the rake angle of the pillar;

a depression in the rearward facing inner surface having an interior surface defined by:

a pillowed reflective surface substantially vertically oriented and rearward facing, having a basic surface provided with a plurality of pillows, each of said pillows having a set of control points defining the corners of said pillow, a set of edge control points defining the edges of said pillow, and a set of interior control points thereon, each pillow having a predetermined horizontal curvature angle from a tangent of the basic surface to the horizontal tangent of the pillowed surface and a predetermined vertical curvature angle from the tangent of the basic surface to the vertical tangent of the pillowed surface, measured at a corner control point of said pillow; and a generally outboard facing reflective surface adjacent said pillowed reflective surface;

a generally horizontal reflective surface adjacent said pillowed reflective surface and said generally outboard facing reflective surface;

a lens mounted over the reflector defining a tail lamp interior, the lens having a plurality of flutes on an interior surface thereof oriented at a predetermined flute angle from a vertical axis and having a predetermined width-to-radius ratio;

light source means mounted in the interior proximate the pillowed surface for generating light within the tail lamp; and attachment means for attaching the reflector to the pillar.

10. A tail lamp as recited in claim 9 wherein the plurality of pillows on the pillowed reflective surface are described by a Bezier type equation as follows:

$$R(u, v) = \sum_{j,k=0}^{M,N} \left(\frac{M!}{j!(M-j)!}\right)\left(\frac{N!}{k!(N-k)!}\right) u^j v^k (1-u)^{M-j}(1-v)^{N-k} R_{jk}$$

where u and v are position parameters for each of the plurality of pillows of the reflector inner surface;

R(u,v) is a position vector for a point on one of said plurality of pillows of the pillowed reflective surface;

j and k are counters in the equation;

$R_{jk}$ is a position vector of one of said control points on one of said plurality of pillows of the pillowed reflective surface; and M and N are dimensional limits in each dimension defining the pillowed surface.

11. A tail lamp as recited in claim 10 wherein the control points of the pillowed surface are such that a normal to a line connecting corner control points to neighboring control points and a normal of the basic surface at a corner control point form angle ($\theta_h$) in the horizontal plane and angle ($\theta_v$) in the vertical plane.

12. A tail lamp as recited in claim 9, wherein each of said plurality of pillows has a pillow surface with a horizontal and a vertical cross-section shaped from one of a circle or an ellipse.

13. A tail lamp as recited in claim 9, wherein the pillowed reflective surface is shaped as a sphere, a paraboloid, an ellipsoid, or a hyperboloid.

14. A tail lamp as recited in claim 9, wherein the predetermined flute angle is between approximately 0° and 35°.

15. A tail lamp as recited in claim 9, wherein the width-to-radius ratio is between approximately 0.1 and 2.0.

16. A tail lamp as recited in claim 9, wherein the predetermined horizontal curvature angle is between approximately 2.5° and 25°.

17. A tail lamp as recited in claim 9, wherein the predetermined vertical curvature angle is between 1.5° and 15°.

18. On an automotive vehicle having a rear structural body pillar with a generally large forward rake angle, a tail lamp comprising:

a reflector having:

a rearward facing reflective inner surface oriented at substantially the rake angle of the pillar;

a depression in the rearward facing inner surface having an interior surface defined by;

a pillowed reflective surface substantially vertically oriented and rearward facing, having a basic surface provided with a plurality of pillows, each of said pillows having a set of corner control points defining the corners of said pillow, a set of edge control points defining the edges of said pillow and a set of interior control points thereon, each pillow having a predetermined horizontal curvature angle from a tangent of the basic surface to a horizontal tangent of the pillowed surface and a predetermined vertical curvature angle from a tangent of the basic surface to a vertical tangent of the pillowed surface, measured at a corner control point of said pillow; and a generally outboard facing reflective surface adjacent said pillowed reflective surface;

a generally horizontal reflective surface adjacent said pillowed reflective surface and said generally outboard facing reflective surface;

a light source mounted in the interior proximate the pillowed surface;

a fluted lens mounted over the reflector;

wherein the plurality of pillows cooperate with the flutes of the lens to direct a portion of light from the light source rearward and inboard over the outboard facing reflective surface; and at least one pillar attachment member.

19. A tail lamp as recited in claim 18 wherein the plurality of pillows on the pillowed reflective surface are described by a Bezier type equation as follows:

$$R(u, v) = \sum_{j,k=0}^{M,N} \left(\frac{M!}{j!(M-j)!}\right)\left(\frac{N!}{k!(N-k)!}\right) u^j v^k (1-u)^{M-j}(1-v)^{N-k} R_{jk}$$

where, u and v are position parameters for each of the plurality of pillows of the reflector inner surface;

R(u,v) is a position vector for a point on one of said plurality of pillows of the pillowed reflective surface;

j and k are counters in the equation;

$R_{jk}$ are position vectors of a control point on one of said plurality of pillows of the pillowed reflective surface; and M and N are degrees of the Bezier type equation.

* * * * *